US007627131B2

(12) United States Patent
Nielsen et al.

(10) Patent No.: US 7,627,131 B2
(45) Date of Patent: Dec. 1, 2009

(54) FLEXIBLE EARPIECE FOR A HEARING AID

(75) Inventors: Henrik Nielsen, Roskilde (DK); Kasper H. Kristiansen, Valby (DK)

(73) Assignee: GN Resound A/S (DK)

( * ) Notice: Subject to any disclaimer, the term of this patent is extended or adjusted under 35 U.S.C. 154(b) by 499 days.

(21) Appl. No.: 11/117,020

(22) Filed: Apr. 28, 2005

(65) Prior Publication Data

US 2005/0244026 A1 Nov. 3, 2005

Related U.S. Application Data

(60) Provisional application No. 60/521,474, filed on May 3, 2004.

(30) Foreign Application Priority Data

May 3, 2004 (DK) ..... 2004 00706

(51) Int. Cl.
*H04R 25/00* (2006.01)

(52) U.S. Cl. ..... 381/328; 381/380; 181/135

(58) Field of Classification Search ..... 381/73, 381/328, 380; 181/129, 135, 130
See application file for complete search history.

(56) References Cited

U.S. PATENT DOCUMENTS

| | | | | |
|---|---|---|---|---|
| 3,934,100 | A * | 1/1976 | Harada | 181/135 |
| 3,935,401 | A | 1/1976 | Shore et al. | |
| 4,055,233 | A * | 10/1977 | Huntress | 181/135 |
| 5,535,282 | A * | 7/1996 | Luca | 381/328 |
| 5,654,530 | A * | 8/1997 | Sauer et al. | 181/130 |
| 6,513,621 | B1 * | 2/2003 | Deslauriers et al. | 181/130 |
| 7,079,662 | B2 * | 7/2006 | Niederdrank | 381/328 |
| 2003/0002700 | A1 * | 1/2003 | Fretz et al. | 381/330 |
| 2003/0174846 | A1 * | 9/2003 | Niederdrank | 381/23.1 |

FOREIGN PATENT DOCUMENTS

| | | |
|---|---|---|
| WO | WO-00/53094 | 9/2000 |
| WO | WO-01/69972 | 9/2001 |

OTHER PUBLICATIONS

Zwislocki, J., Acoustic Filters as Ear Defenders (Aug. 30, 1950), The Journal of the Acoustical Society of America, vol. 21, No. 1, (Jan. 1951), pp. 36-40.*

European International Type Search Report SN 43182 DK, Applicant: GN ReSound A/S, Form PCT/ISA 201a, dated Jan. 26, 2005 ( pages).

* cited by examiner

*Primary Examiner*—Curtis Kuntz
*Assistant Examiner*—Jesse A Elbin
(74) *Attorney, Agent, or Firm*—Vista IP Law Group, LLP.

(57) ABSTRACT

The present invention relates to a flexible ear mould fitting a large number of users while providing a high level of comfort and comprising a base and at least one sidewall that is attached to the base and has an edge that extends substantially from the base to an opening of the earpiece, the width of the opening fitting within the ear canal of the user.

38 Claims, 8 Drawing Sheets

FLEXIBLE EARPIECE FOR A HEARING AID

RELATED APPLICATION DATA

This application claims priority from provisional U.S. patent application Ser. No. 60/521,474, filed May 3, 2004 and Danish Patent Application No. PA 2004 00706, filed May 3, 2004.

TECHNICAL FIELD

The present invention relates to the field of hearing aid earpieces. More particularly, the invention relates to a flexible ear mould, which fits a large number of users while providing a high level of comfort.

BACKGROUND OF THE INVENTION

Behind-the-ear hearing aids in which a sound tube conducts sound generated by the receiver of the hearing aid into the ear canal are well known in the art. In order to position the sound tube securely and comfortably in the ear canal, an earpiece is provided for insertion into the ear canal of the user. Typically, the earpiece is individually adapted to the human anatomy of the ear of the user.

A conventional earpiece which secures the end of the flexible hearing aid tube within the ear canal has to be Individually custom manufactured to fit the user's ear to sufficiently secure the hearing aid tube In place In the ear canal and prevent the earpiece from falling out of the ear and avoid acoustical feed backs, e.g., when the user is moving around. The custom made earpiece adds to the cost of the device and the time needed to fit the hearing aid.

U.S. Pat. No. 3,935,401 discloses an earpiece for an acoustic headset. The acoustic headset has sound transmitting tubes fitted with earpieces designed to engage the wearer's outer ear. The earpieces have a central hub that receives the acoustic tube, and a flange projecting symmetrically from the hub and intended to seal against the outer ear in the region of the ear canal. The flange becomes deformed as the wearer adjusts the centre of the earpiece into position communicating effectively with the ear canal. By using thinned regions, or sloping webs amounting to corrugations, or slots, or combinations of these, one region of the flange Is encouraged to wrinkle or to shrink so as to allow the central passage of the earpiece to be moved opposite a wearer's ear canal and yet the remainder of the flange can stand out and become conformed reasonably to the wearer's outer ear, acting with reasonable effectiveness to exclude ambient sounds.

DESCRIPTION OF THE INVENTION

It is an object of the present invention to provide an earpiece that can be securely and comfortably fastened inside the ear canal of a user, and that is provided in standard sizes for substituting custom made earpieces.

It is a further object to provide an earpiece having a shape that allows provision of a vent, if desired, especially a vent that is not easily deformed during use.

Thus, in a first aspect of the invention, a flexible earpiece for positioning completely in the ear canal of a user is provided that comprises a base, and at least one sidewall that is attached to the base and has an edge that extends substantially from the base to an opening of the earpiece, the width of the opening fitting within the ear canal of the user.

The base constitutes the bottom of the earpiece, i.e. the part of the earpiece that is supposed to be positioned deepest in the ear canal when the earpiece is worn by a hearing impaired user. The base is sufficiently stiff and thick to carry and support the attached sidewall without being deformed. The sidewall is made from a thin sheet of a soft and flexible material and it functions to hold the earpiece in an intended position within the ear canal of the user. In this position, the base does not touch the ear canal. The edge of the sidewall allows the sidewall to adjust to the size and shape of the user's ear canal as the edge may move sideways along the surface of the ear canal when the earpiece is being inserted and pressure thereby is applied to the sidewall by the ear canal. This sideways displacement provides the advantage that the sidewall can adjust to the shape and size of the user's ear canal without wrinkling and thereby loosing contact with the ear canal, which may cause undesirable leaks to occur.

Preferably, the earpiece has a first sidewall and a second sidewall, each of which has an edge that extends from adjacent parts of the base to the opening. This arrangement of the sidewalls and their respective edges allows the edges to move sideways in opposite directions along the surface of the ear canal.

In a preferred embodiment, the sidewalls are mutually overlapping. In this case, the edge of the first sidewall is covered by the second sidewall whereby only one of the edges is in direct contact with the skin of the ear canal when the earpiece is in use. This reduces the risk of undesired openings or leaks in the earpiece along the edges of the sidewalls.

Preferably, the sidewall of the earpiece has a generally conical shape. Thus, the insertion depth of the earpiece in a wearer's ear canal may be chosen to correspond to the size of the specific ear canal, which should be somewhere in between the smallest and largest cross sections of the conical sidewall. Thereby, the earpiece may fit into a wide range of sizes of ear canals.

The conical shape may have a substantially elliptical cross-section. This is advantageous, as most ear canals are, more or less, oval or elliptical in shape. Thus, the earpiece will fit well and will also be easier for the user to insert in an optimal position in the ear canal.

It is preferable, that the first sidewall is thickest along the edge of the first sidewall, while the second sidewall is thinnest along the edge of the second sidewall. Thus, the first sidewall will be stiffer along its edge, while the second sidewall will be softer or more flexible along the edge. If the edge of the second sidewall is positioned between the ear canal and the first sidewall, then the stiffness of the first sidewall will provide an outward pressure on the second sidewall in the direction of the ear canal surface. The flexibility of the second sidewall therefore assures close contact between itself and both of the first sidewall and the surface of the ear canal. Thereby, undesired leaks are prevented along the edges of the sidewalls as well as a close and tight fit in the ear canal.

The thinnest parts of the sidewalls are preferably about half the thickness of the thickest parts. The thinnest part may have a thickness in the range of 0.05 mm to 0.5 mm, such as in the range of 0.1 mm to 0.45 mm, such as in the range of 0.15 mm to 0.4 mm, such as in the range of 0.2 mm to 0.35 mm, such as in the range of 0.25 mm to 0.3 mm. Accordingly, the thickest part may have a thickness in the range of 0.1 mm to 1.0 mm, such as in the range of 0.2 mm to 0.9 mm, such as in the range of 0.3 mm to 0.8 mm, such as in the range of 0.4 mm to 0.7 mm, such as in the range of 0.5 mm to 0.6 mm.

The base of the earpiece preferably comprises means for injecting sound into the ear canal of the user.

The means for injecting sound into the ear canal may comprise a connector to a sound tube. The sound tube transmits sound output from the loudspeaker of a hearing aid and injects it into the ear canal through an opening in the base. The hearing aid to which the sound tube is connected may be positioned outside the ear canal, e.g. behind the ear of the user, or it may be mounted within the earpiece itself.

Alternatively, the means for injecting sound into the ear canal may comprise a receiver, i.e. a hearing aid loudspeaker. In this case, the receiver is mounted directly on or in close proximity to the base, so that sound emitted by the receiver may be transmitted to the ear canal through an opening in the base. The receiver may be a part of a complete hearing aid mounted on the base, that is a hearing aid of the ITE (In-The-Ear) type, or it may be connected by means of e.g. an electrical wire to a hearing aid positioned outside the ear, such as a BTE (Behind-The-Ear) hearing instrument.

Furthermore, the base may comprise a vent opening. When the earpiece is inserted into the user's ear canal, the vent provides communication between the ear canal behind the base of the earpiece and the surroundings. The vent opening may be a hole in the base having a substantially circular or elliptical shape. Thereby, occlusion is prevented and the user may furthermore be able to receive some sound bypassing the hearing aid processing, i.e. natural sound. The latter is often desirable when the user has only limited hearing impairment, such as in the high frequency range. In this case, the user may hear low frequency sounds very well and therefore does not need the hearing aid to process these.

Often, it is not desirable that the user receives the same sound both naturally through the vent and processed by the hearing aid. This may be the case e.g. when the hearing aid processing causes an audible delay between the natural and processed sound. To avoid this, the vent opening may be connected to an acoustic filter extending from the base. The acoustic filter may be a low-pass filter, a band-pass filter or a high-pass filter designed to fit a group of typical frequency dependent hearing losses in the sense that sound which the user will be able to hear naturally is transmitted by the filter, while sound in the frequency range that is subject to hearing impairment will not be transmitted by the filter. Thereby, the user will hear either natural or processed sound instead of a possibly distorted mixture of these.

Preferably, the base comprises a recess extending substantially across the base. The recess may act as a hinge as it divides the base in two parts that may tilt relative to each other when pressure is applied to the sidewall(s) of the earpiece. Thereby, deformation of the base is limited to the tilting about the recess, so if a vent opening is restricted to one of the two parts of the base, the vent opening will not easily be deformed when the base is subjected to stress during use of the earpiece.

The earpiece is preferably moulded as an integral unit. A highly suitable material is silicone.

The invention will now be described in further detail with reference to the accompanying drawings.

DETAILED DESCRIPTION OF THE DRAWINGS

Figure 1:
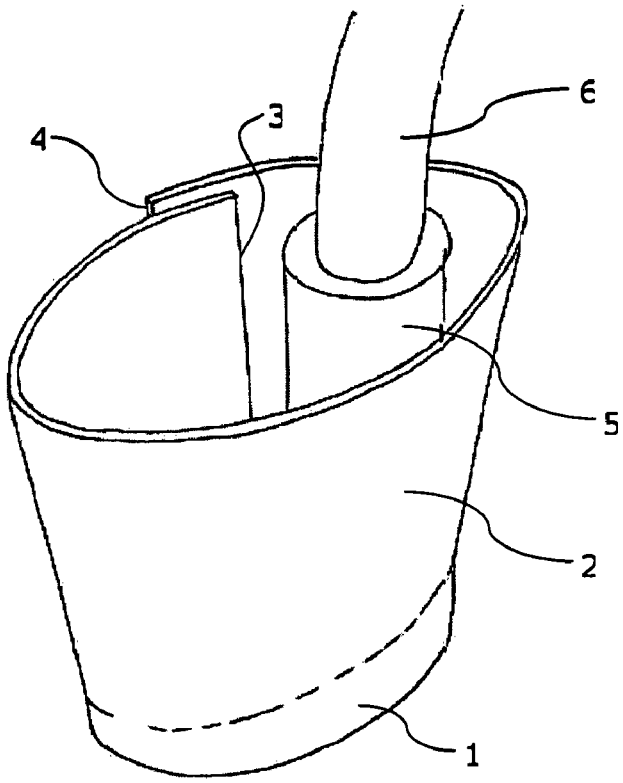
FIG. 1 shows an earpiece with one sidewall in a relaxed state.

FIG. 1 shows an earpiece according to an exemplary embodiment of the invention. The earpiece comprises a base 1 and a sidewall 2, which extends from the base 1 and has a conical shape with an oval or elliptical cross-section. The sidewall 2 comprises edges 3 and 4 both extending from the base towards the opening of the earpiece. The sidewall overlaps itself at the ends as defined by the edges 3 and 4, that is, the circumferential length of the sidewall is actually longer than the actual circumference of the sidewall 2. Inside the sidewall, a connector 5 is mounted on the base 1 for receiving sound output by a hearing instrument through a sound tube 6 and injecting it into the ear canal of a user through an opening (not shown) in the base 1.

Figure 2:
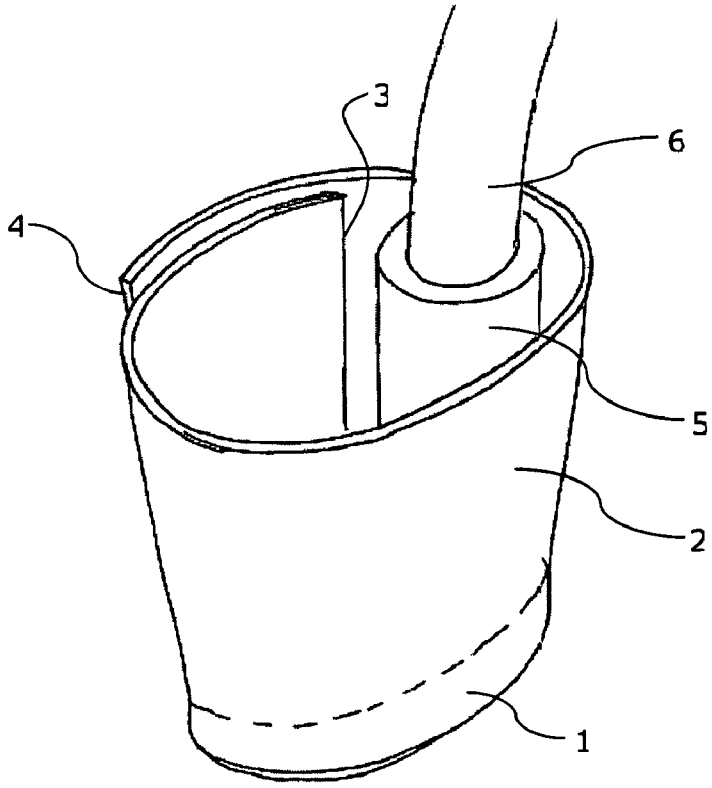
FIG. 2 shows the earpiece with one sidewall depicted in FIG. 1, in a compressed state.

When the earpiece is inserted into a user's ear canal, pressure is applied to the sidewall. This will, as shown in FIG. 2 cause the edges 3 and 4 to move farther apart, so that the overlap increases and the circumference of the sidewall decreases correspondingly. The pressure applied to the sidewall by the user's ear canal will provide close contact between the overlapping parts of the sidewalls so that no leaks occur along the edges of the sidewall.

Figure 3:
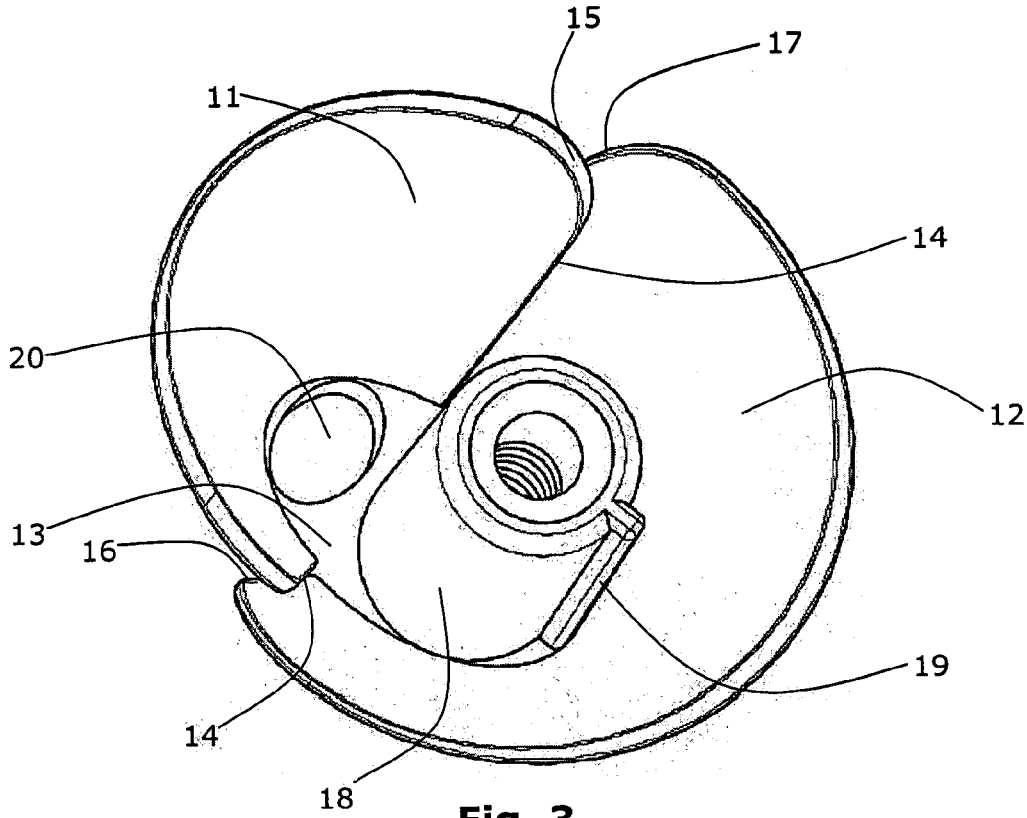
FIG. 3 shows a first perspective view of an earpiece with two sidewalls.

FIG. 3 shows another exemplary embodiment of the invention. This earpiece has two sidewalls 11, 12 extending from a base 13. The sidewall 11 has edges 14 and is somewhat smaller than sidewall 12, which has edges 16. Together, the sidewalls 11, 12 form an altogether conical sidewall. The smaller sidewall 11 is positioned so that its edges 14 may move relative to the edges 16 within the larger sidewall 12 when pressure is applied to (or released from) the sidewalls during use of the earpiece in a user's ear canal. Both sidewalls 11, 12 have rounded transition sections 15, 17 between the edges 14, 16 and the outer rim of the sidewalls 11, 12. This reduces the risk of collision between the edges 14, 16 in comparison to e.g. simple sharp corners. A sound tube connector 18 is mounted on the base 13 above an appropriate opening (not shown) in the base 13 through which sound provided by a sound tube (not shown) may be injected into the ear canal of the user. The sound tube may be shaped to fit a part of the outer ear and therefore has to be mounted in the connector 18 with a predetermined orientation. This is assured by the protrusion 19 on the side of the connector 18 which will fit into a corresponding recess in the tube. Finally, a vent opening 20 is provided in the base 13.

It should be noted that the outer sidewall 12 is thinner than the inner sidewall 11 in the regions close to the respective edges 16 and 14. Therefore, the outer wall will tend to be softer and more flexible in the vicinity of the edges 16 than the inner wall in the corresponding regions. Thus, when the earpiece is inserted into a user's ear canal, the stiffness of the inner sidewall 11 will provide an outward pressure on the overlapping part of the outer sidewall 12 in the direction of the ear canal surface. The flexibility of the outer sidewall 12 at the same time provides close contact between itself and both of the inner sidewall 11 and the surface of the ear canal. Thereby, undesired leaks are prevented along the edges 14, 16 of the sidewalls 11, 12 as well as a close and tight fit in the ear canal.

Furthermore, the inner wall 11 is thinnest, and therefore most flexible, in the part about midway between the edges 14. This further enhances the above effect, that the inner wall 11 will provide a pressure on the overlapping part of the outer wall 12. Analogously, the outer wall 12 has its thickest section about halfway between its edges 16.

The thinnest parts of the sidewalls 11, 12 are preferably about half the thickness of the thickest parts. The thinnest parts may thus have a thickness in the range of 0.05 mm to 0.5 mm, such as in the range of 0.1 mm to 0.45 mm, such as in the range of 0.15 mm to 0.4 mm, such as in the range of 0.2 mm to 0.35 mm, such as in the range of 0.25 mm to 0.3 mm. Accordingly, the thickest parts may have a thickness in the range of 0.1 mm to 1.0 mm, such as in the range of 0.2 mm to 0.9 mm, such as in the range of 0.3 mm to 0.8 mm, such as in the range of 0.4 mm to 0.7 mm, such as in the range of 0.5 mm to 0.6 mm.

Figure 4:
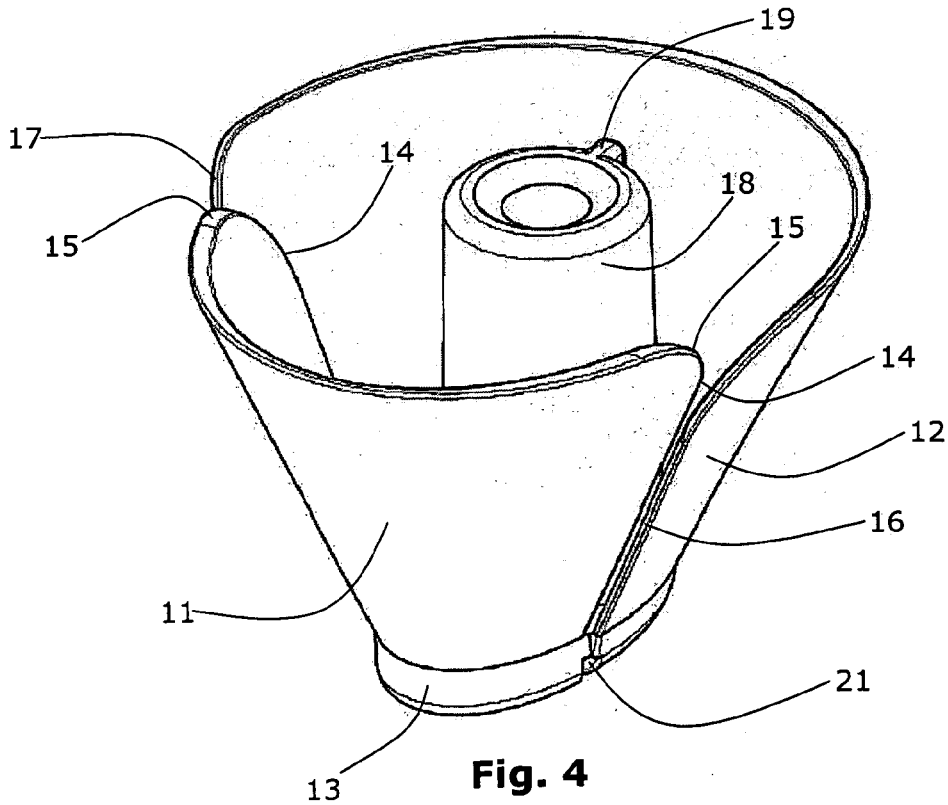
FIG. 4 shows a second perspective view of an earpiece with two sidewalls.

FIG. 4 shows an earpiece similar to that depicted in FIG. 3 from a different angle. Here, a recess 21 provided in the downside part of the base 13 can be seen. This recess 21 is even more apparent in FIG. 5 where it can be seen that it extends across the downside of the oval base 13, thus dividing the base 13 in two sections, one containing the vent opening 20, and another containing the opening 22 for injecting sound into the user's ear canal. The recess 21 functions as a hinge, so that when force is exerted upon the sidewalls 11, 12, the two sections of the base 13 may tilt about the recess 21. Thereby, the base 13 is exposed to less stress, and deformation of the vent opening 20 is avoided, when the sidewalls 11, 12 move relative to one another.

Figure 5:
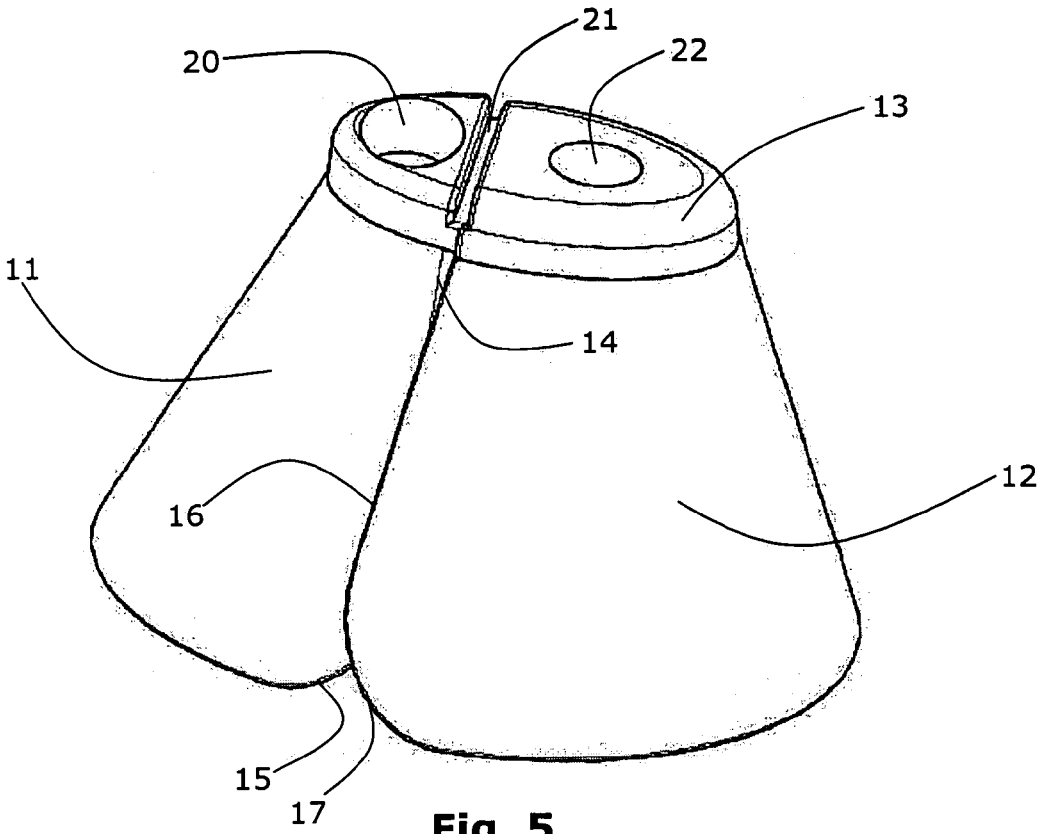
FIG. 5 shows a third perspective view of an earpiece with two sidewalls.
Figure 6:
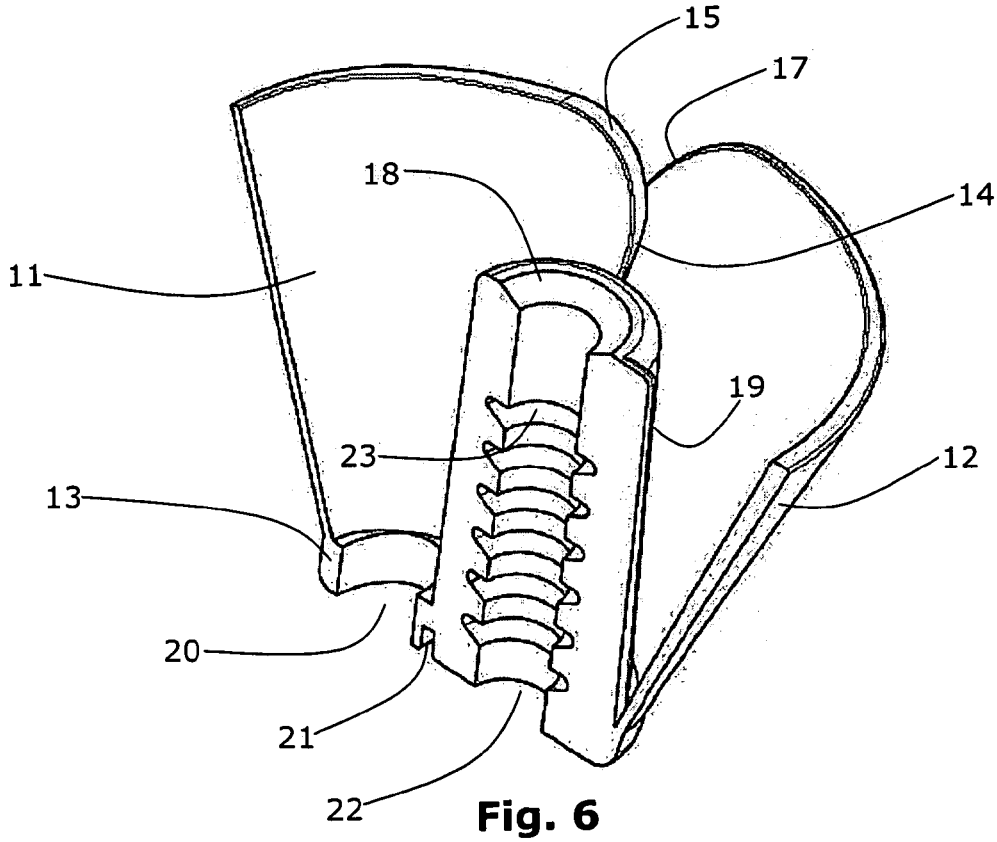
FIG. 6 shows a cross sectional view of an earpiece with two sidewalls.

FIG. 6 shows a cross-sectional view of an earpiece similar to that depicted in FIGS. 3-5. Here it can be seen that the sound tube connector 18 comprises a number of ring shaped grooves 23 so that the sound tube may be held in various depths in the sound tube connector 18, thus making it possible to use the same length of sound tube to a wide range of hearing impaired users without having to adapt the length of the sound tube to the specific dimensions of the user's ear.

Figure 7:
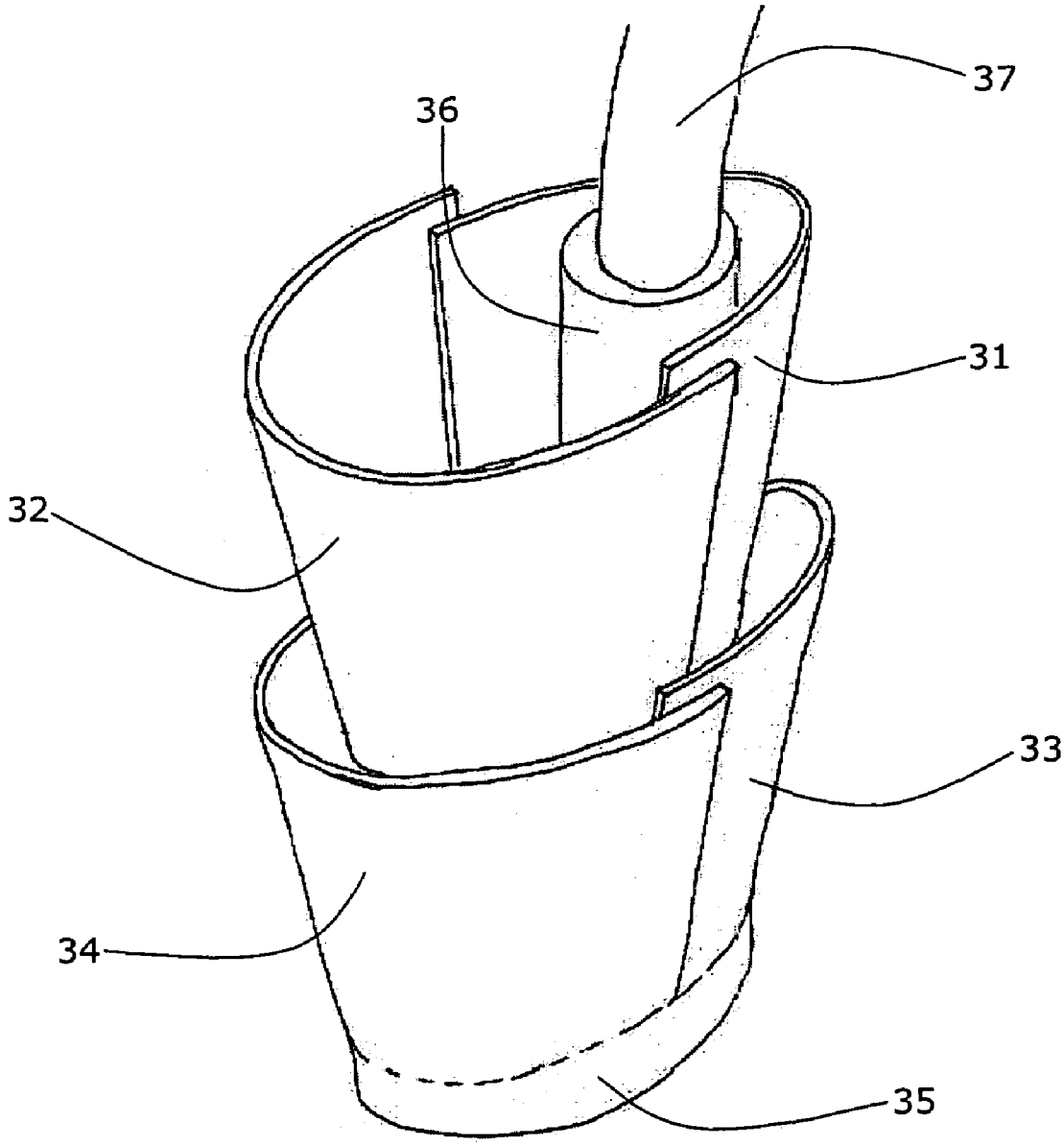
FIG. 7 shows an earpiece with two interconnected sections each having two sidewalls.

FIG. 7 shows yet another exemplary embodiment of the invention, wherein two earpieces similar to the one depicted in FIGS. 3-6 are stacked. In other words, a first set of sidewalls 33, 34 are attached to a base 35, and within them a second set of sidewalls 31, 32 is provided. By making the second set of sidewalls 31, 32 somewhat larger in circumference than the first set 34, 35, this earpiece may fit an even larger number of potential users than the earpieces with just one single set of sidewalls. If the first set is too small to provide a close fit to the user's ear canal, the second set may be sufficiently large. A connector 36 and a sound tube 37 are also provided in this exemplary embodiment.

Figure 8:
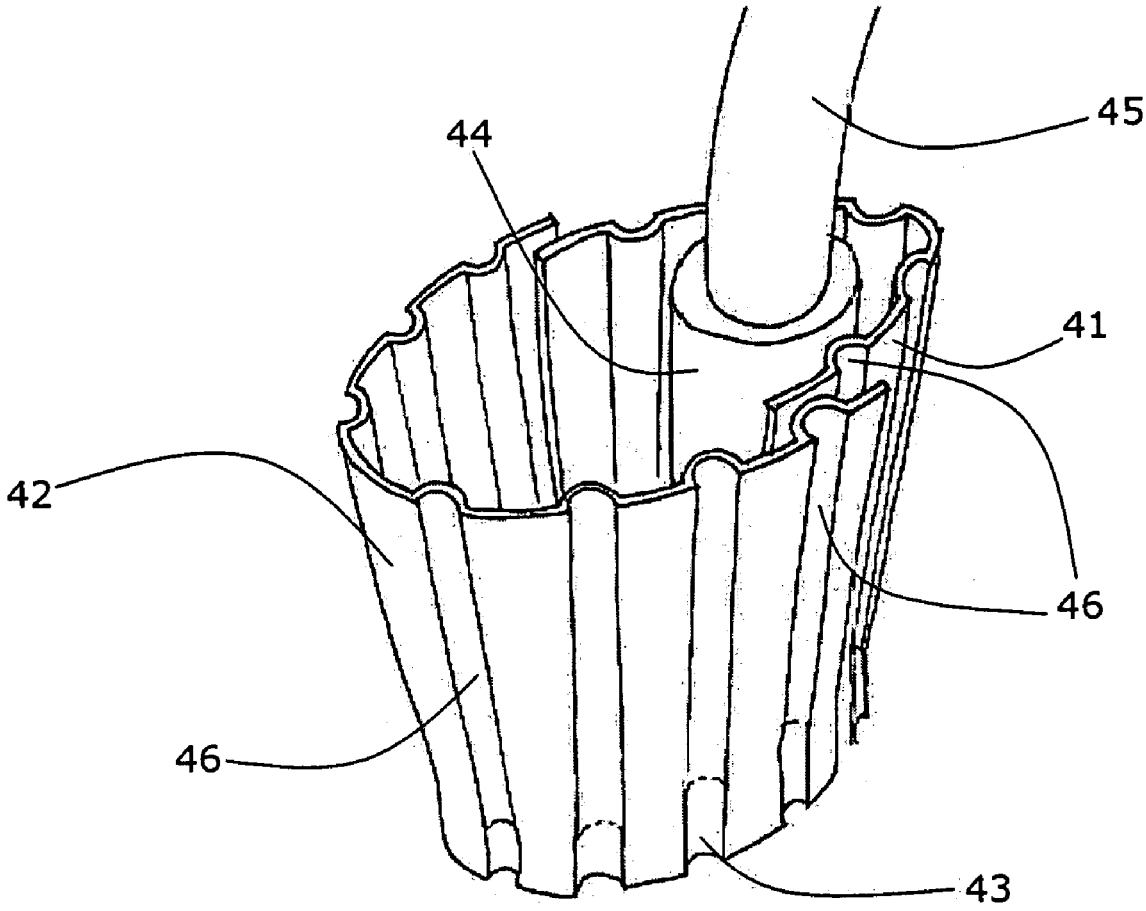
FIG. 8 shows an earpiece with two sidewalls wherein the surface of the sidewalls comprises ventilation grooves.

FIG. 8 shows an even further exemplary embodiment of the invention. This earpiece again comprises two sidewalls 41, 42 extending from a base 43. In this example, ventilation of the ear canal Is provided by ventilation grooves in the surface of the sidewalls. The sound to be injected into the user's ear canal is provided by a sound tube 45 and a connector 44 attached to the base 43.

Figure 9:
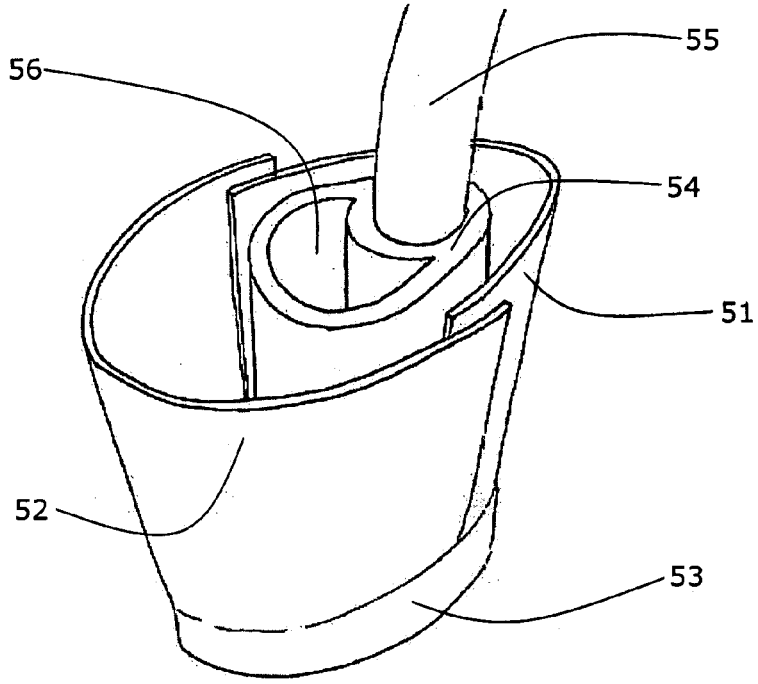
FIG. 9 shows an earpiece with two sidewalls and a pipe vent.

FIG. 9 shows an exemplary embodiment of the invention, wherein a vent 56 is provided as a piece of tube parallel to and integral with a sound tube connector 54 that receives sound to be injected into the ear canal from the sound tube 55. Depending on the length and cross-sectional shape of the vent tube 56, this vent 56 may function as an acoustic filter, such as a low pass filter. Sidewalls 51, 52 extend as in the previous examples from the base 53.

Figure 10:
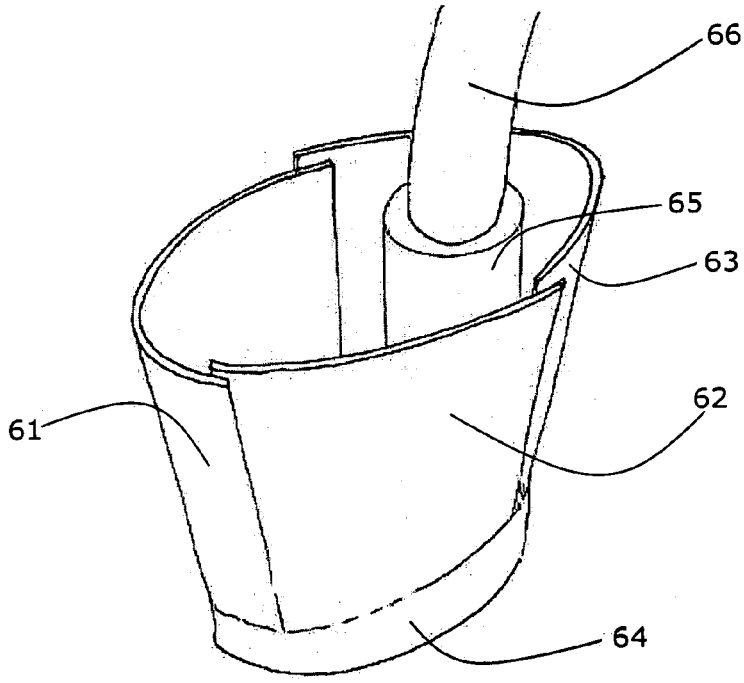
FIG. 10 shows an earpiece with three sidewalls.

FIG. 10 shows a further exemplary embodiment of the invention, wherein three sidewalls 61, 62, 63 extend from the base 64. In this example, each of the three sidewalls 61, 62, 63 has two edges and overlap slightly with their respective neighbours. For each of the sidewalls 61, 62, 63 one edge is overlapping one neighbour on the inside while the other edge is overlapping the other neighbour on the outside. A sound tube 66 and a corresponding connector 65 are also shown.

Figure 11:
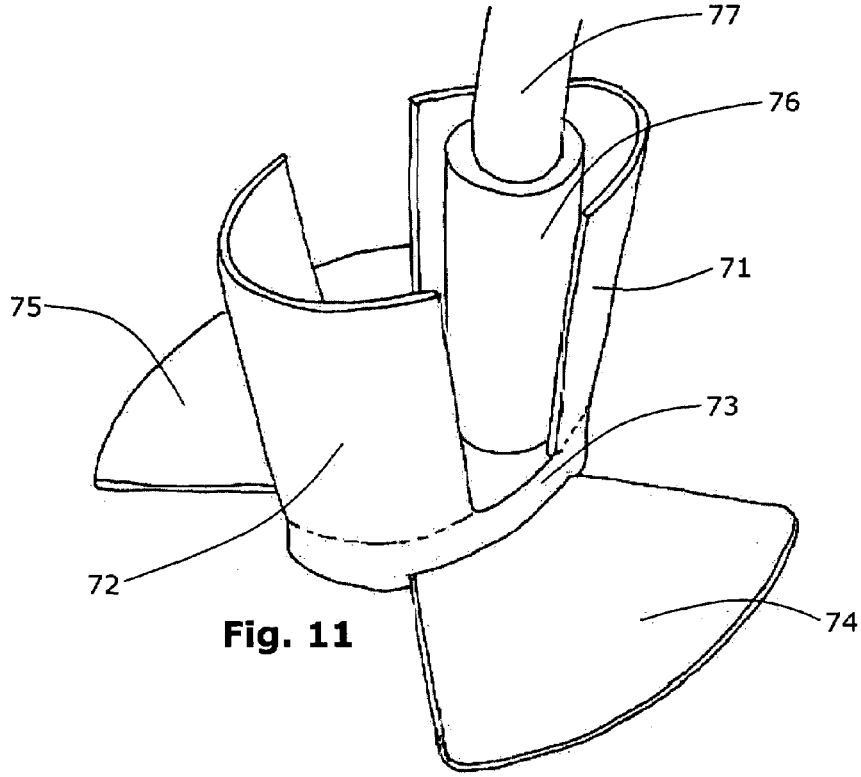
FIG. 11 shows a relaxed state of an earpiece with four sidewalls.
Figure 12:
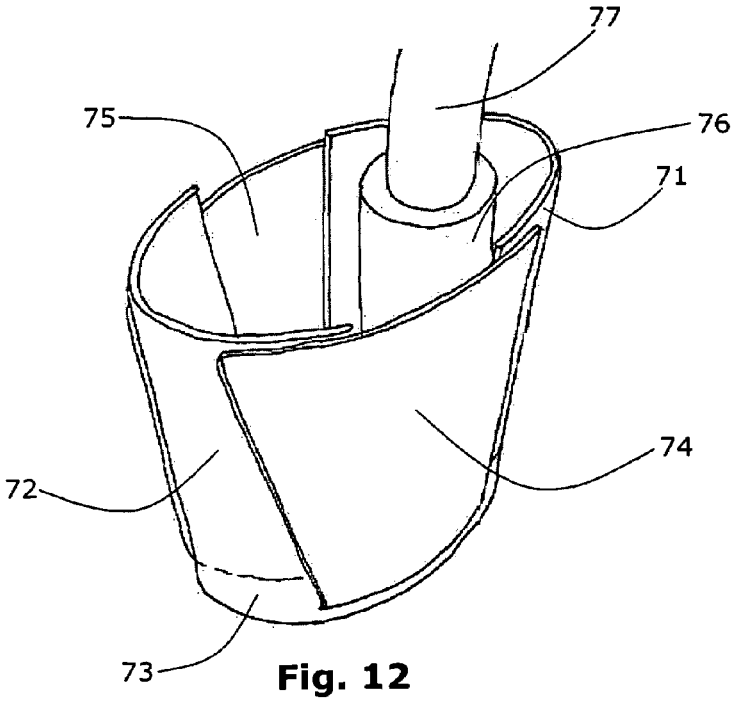
FIG. 12 shows the earpiece of FIG. 11 in a compressed state.

FIG. 11-12 shows yet another exemplary embodiment of the invention with two relatively stiff sidewalls 71, 72 extending from a base 73, and two relatively flexible sidewalls 74, 75 attached to the side of the base 73. When the earpiece is inserted into an ear canal of a hearing impaired user, the two relatively flexible sidewalls 74, 75 will be moved so as to cover the openings between the edges of the relatively stiff sidewalls 71, 72. This is shown in FIG. 12. Also in this example, a sound tube 77 and a corresponding connector 76 are shown.

Figure 13:
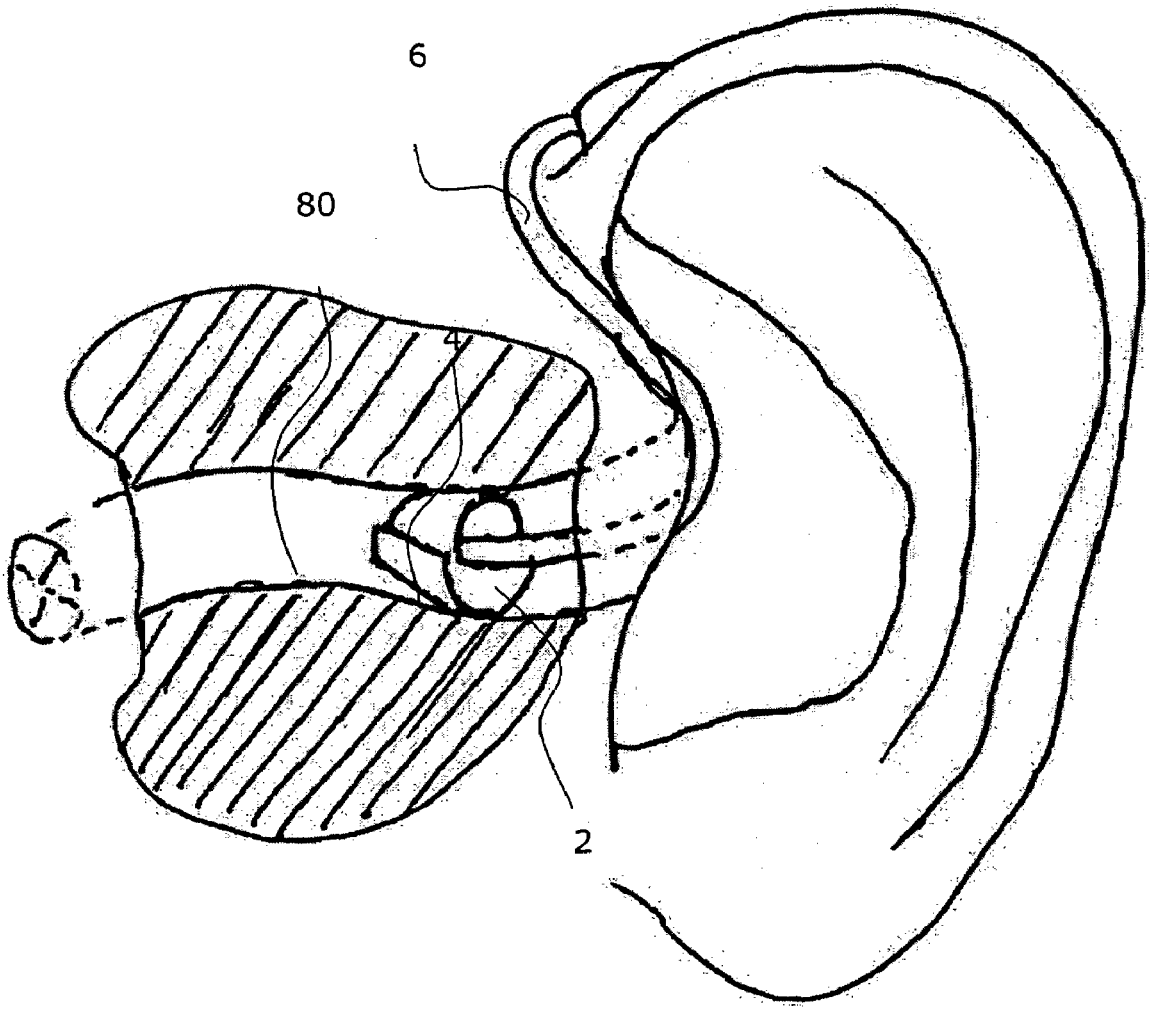
FIG. 13 shows an earpiece according to the invention in position in the ear canal of a user.

Finally, FIG. 13 shows an embodiment of the earpiece according to the present invention in position in the ear canal 80 of a user. The illustrated embodiment fits the ear canal 80 in such a way that the earpiece is positioned completely in the ear canal of the user. The illustrated earpiece is provided in standard sizes (i.e. they are not custom made) and is comfortable to wear and aesthetical and as explained above it automatically fits the ear canal 80 whereby it is securely and comfortably fastened in the ear canal of the user.

In one embodiment of the invention, the base has a substantially ellipsoidal shape and one of the standard sized earpieces has a base with a largest width of app 6 mm and a smallest width of app. 5 mm, and an substantially ellipsoidal opening of the earpiece with a largest width of app. 12 mm and a smallest width of app. 11 mm. Further, the distance between the base and the opening in a direction perpendicular to the base is app. 8 mm.

All of the above exemplary embodiments may be moulded as partial or integrated units from any suitable material. However, silicone has proven to be very suitable and comfortable to the users.

It should be noted, that although all the above examples have only mentioned a connector and a sound tube for providing the processed sound to be injected into the user's ear canal, all of the shown earpieces could equally well have a hearing aid receiver mounted on or close to the base in combination with an appropriate electrical connection to the output terminals of the hearing aid instead of the sound tube. Furthermore, the entire hearing aid may be contained on the base within the sidewalls to form an ITE (In-The-Ear) hearing instrument or the hearing aid may be of the BTE (Behind-The-Ear) type where the processed sound is transmitted either acoustically or electrically from a hearing aid positioned outside the user's ear canal to the part of the earpiece that injects it into the user's ear canal.

The invention claimed is:

1. A flexible earpiece for positioning completely in the ear canal of a user, composing a base, and a first sidewall that is attached to the base and having edges that extends from the base to an opening of the earpiece, the width of the opening fitting within the ear canal of the user, the edges defining two ends of the sidewall, wherein the sidewall overlaps itself at the two ends defined by the edges, wherein an amount of the overlap is variable in response to pressure applied to the sidewall.

2. The earpiece according to claim 1, wherein the sidewall has a generally conical shape.

3. The earpiece according to claim 2, wherein the conical shape has a substantially elliptical cross-section.

4. The earpiece according to claim 1, wherein the base comprises a component for injecting sound into the ear canal.

5. The earpiece according to claim 4, wherein the component for injecting sound comprises a connector to a sound tube.

6. The earpiece according to claim 4, wherein the component for injecting sound comprises a receiver.

7. The earpiece according to claim 1, wherein the base comprises a vent opening.

8. The earpiece according to claim 7, wherein the vent opening has a substantially circular shape or a substantially elliptical shape.

9. The earpiece according to claim 7, wherein the vent opening is connected to an acoustic filter extending from the base.

10. The earpiece according to claim 9, wherein said acoustic filter is a low-pass filler.

11. The earpiece according to claim 1, wherein the base comprises a recess extending substantially across the base.

12. The earpiece according to claim 1, wherein the earpiece is molded as an integral unit.

13. The earpiece according to claim 1, wherein the sidewall has a first portion and a second portion, the first portion of the sidewall being attached to the base and the second portion of the sidewall defining the opening of the earpiece, wherein the width of the opening allows the whole earpiece to fit within the ear canal of the user.

14. The earpiece according to claim 1, wherein the first sidewall has air inner surface and an outer surface, wherein the two ends overlap each other such that the outer surface at one of the two ends is at least in part, covered by the inner surface of the sidewall at the other one of the two ends.

15. The flexible earpiece of claim 1, wherein the first side wall forms an angle that is less than 30° with respect to a longitudinal axis that extends through the opening.

16. A flexible earpiece for positioning completely in the ear canal of a user, comprising:

a base; and a first sidewall and a second sidewall each of which having an edge that extends from the base to an opening of the earpiece, the width of the opening fitting within the ear canal of the user, wherein the sidewalls create an overlap, and wherein an amount of the overlap is variable in response to pressure applied to the one or both of the sidewalls;

wherein the first sidewall is thicker along its edge than the second sidewall along its edge.

17. The earpiece according to clam 16, wherein the first sidewall is thickest along the edge of the first sidewall, while the second sidewall is thinnest along the edge of the second sidewall.

18. The flexible earpiece of claim 16, wherein the first side wall forms an angle that is less than 30° with respect to a longitudinal axis that extends through the opening.

19. A flexible earpiece for positioning completely in the ear canal of a user, comprising a base;

a first sidewall with a first edge that extends from the base to an opening of the earpiece; and a second sidewall with a second edge that extends from the base to the opening;

wherein the earpiece has a relaxed state in which no external pressure is applied to one or both of the first and second sidewalls, the first sidewall and the second sidewall overlapping at their respective edges when the earpiece is in the relaxed state; and wherein an amount of the overlap increases in response to a pressure applied to one or both of the first and second sidewalls.

20. The flexible earpiece of claim 19, wherein the first edge of the first sidewall is thinner than the second edge of the second sidewall.

21. The flexible earpiece of claim 19, wherein the first sidewall has a first middle portion that is thicker than the first edge, and the second sidewall has a second middle portion that is thinner than the second edge.

22. The flexible earpiece of claim 21, wherein the first edge of the first sidewall is thinner than the second edge of the second sidewall.

23. The flexible earpiece of claim 19, wherein the first side wall forms an angle that is less than 30° with respect to a longitudinal axis that extends through the opening.

24. The earpiece according to claim 23, wherein the thinnest part of the sidewalls is bout half the thickness of the thickest part.

25. A flexible earpiece for positioning completely in the ear canal of a user, comprising a base;

a first sidewa11 with a first edge that extends from the base to an opening of the earpiece; and a second sidewall with a second edge that extends from the base to the opening;

wherein the first sidewall has a first middle portion that is thicker than the first edge, and the second sidewall has a second middle portion that is thinner than the second edge.

26. The flexible earpiece of claim 25, wherein the first edge of the first sidewall is thinner than the second edge of the second sidewall.

27. The flexible earpiece of claim 25, wherein the first side wall forms an angle that is less than 30° with respect to a longitudinal axis that extends through the opening.

28. A flexible earpiece for positioning completely in a ear canal of a user, comprising a base;

a first sidewall with a first edge that extends from the base to an opening of the earpiece; and a second sidewall with a second edge that extends from the base to the opening;

wherein the first and second sidewalls are configured to move relative to each other from an initial configuration in which the first and second sidewalls are overlapping at their respective edges when no external pressure is applied to one or both of the first and second sidewalls; and wherein an amount of the overlap increases in response to pressure applied to one or both of the first and second sidewalls.

29. The flexible earpiece of claim 28, wherein the first side wall forms an angle that is less than 30° with respect to a longitudinal axis that extends through the opening.

30. A flexible earpiece for positioning completely in a ear canal of a user, comprising a base;

a first sidewall with a first edge that extends from the base to an opening of the earpiece; and a second sidewall with a second edge that extends from the base to the opening;

wherein at least one of the first and second sidewalls forms an angle that is less than 30° with respect to a longitudinal axis that extends through the opening when the flexible earpiece is in a relaxed configuration; and wherein the first sidewall and the second sidewall overlap each other when the flexible earpiece is in the relaxed configuration.

31. The flexible earpiece of claim 30, wherein the fist edge is thicker than the second edge.

32. A flexible earpiece for positioning completely in the ear canal of a user, comprising:

a base;

a first sidewall with a first edge that extends from the base to an opening of the earpiece; and a second sidewall with a second edge that extends from the base to the opening; and wherein the first edge of the first sidewall and the second edge of the second sidewall are offset relative to each other at the base in a radial direction from a center of the base when the earpiece is in a relaxed state in which no external pressure is applied to one or both of the first and second sidewalls, so that the first sidewall at the first edge will slide over the second sidewall at the second edge, thereby creating an overlap at the first and second edges, in response to pressure applied to one or both of the first and second sidewalls.

33. The flexible earpiece according to claim 32, wherein the first and second sidewalls together form at least a part of a conical shape when the earpiece is in the relaxed state.

34. The flexible earpiece according to claim 32, wherein the first sidewall forms an angle that is less than 30° with respect to a longitudinal axis that extends through the opening.

35. A flexible earpiece for positioning completely in the ear canal of a user, comprising a base;

a first sidewall with a first edge that extends from the base to an opening of the earpiece; and a second sidewall with a second edge that extends from the base to the opening; and wherein the first and second edges are offset with respect to each other at the base in a radial direction from a center of the base, so that the first sidewall at the first edge can slide over the second sidewall at the second edge, thereby creating an overlap at the first and second edges, in response to pressure applied to one or both of the first and second sidewalls.

36. The flexible earpiece according to claim 35, wherein the first and second sidewalls together form at least a part of a conical shape.

37. The flexible earpiece according to claim 35, wherein the first sidewall forms an angle that is less than 30° with respect to a longitudinal axis that extends through the opening.

38. The flexible earpiece according to claim 35, wherein the base has an ellipsoidal shape or a circular shape.

* * * * *